US009958235B2

(12) United States Patent
Lassak et al.

(10) Patent No.: US 9,958,235 B2
(45) Date of Patent: May 1, 2018

(54) ADJUSTING APPARATUS FOR SETTING A RIFLE SCOPE, AND RIFLE SCOPE EQUIPPED WITH THE ADJUSTING APPARATUS

(71) Applicant: Schmidt & Bender GmbH & Co. KG, Biebertal (DE)

(72) Inventors: Raphael Lassak, Wetzlar (DE); Werner Schmidt, Wettenberg/Krofdorf (DE)

(73) Assignee: Schmidt & Bender GmbH & Co. KG, Biebertal (DE)

( * ) Notice: Subject to any disclaimer, the term of this patent is extended or adjusted under 35 U.S.C. 154(b) by 0 days. days.

(21) Appl. No.: 15/398,806

(22) Filed: Jan. 5, 2017

(65) Prior Publication Data

US 2017/0191797 A1 Jul. 6, 2017

(30) Foreign Application Priority Data

Jan. 6, 2016 (DE) ..... 10 2016 100 219

(51) Int. Cl.
*F41G 1/44* (2006.01)
*F41G 1/38* (2006.01)
*F41G 1/18* (2006.01)

(52) U.S. Cl.
CPC ..... *F41G 1/44* (2013.01); *F41G 1/18* (2013.01); *F41G 1/38* (2013.01)

(58) Field of Classification Search
CPC ..... F41G 1/18; F41G 1/38; F41G 1/44; Y10T 74/14; Y10T 74/1494; Y10T 74/20636
USPC ..... 42/122; 74/527, 553, 557
See application file for complete search history.

(56) References Cited

U.S. PATENT DOCUMENTS 4,247,161 A * 1/1981 Unertl, Jr. ..... F41G 1/38 359/424
2009/0044660 A1 2/2009 Bonis
2009/0199452 A1* 8/2009 Huber ..... F41G 1/38 42/125
2010/0175298 A1* 7/2010 Thomas ..... F41G 1/18 42/122

(Continued)

FOREIGN PATENT DOCUMENTS

CN 201 104 166 8/2008
CN 201 706 979 1/2011

(Continued)

*Primary Examiner* — Bret Hayes
(74) *Attorney, Agent, or Firm* — Clark & Brody

(57) ABSTRACT

An adjusting apparatus for setting a rifle scope has a manually actuable adjusting element which is mounted such that it can be rotated about a rotational axis relative to a base. A latching device is arranged between the base and the adjusting element and has latching depressions which are distributed about the rotational axis over the circumference. A first latching element lies opposite one of the latching depressions and is dependent on the rotary position of the adjusting element relative to the base. A locking device has a manually actuable locking element which can be moved from a released position into a locked position, the locking element being coupled to the first latching element via an actuating drive. The first latching element is fixed in the latching depression which lies opposite in each case in the locked position by means of the actuating drive.

26 Claims, 6 Drawing Sheets

(56) References Cited

U.S. PATENT DOCUMENTS

Figure 1:
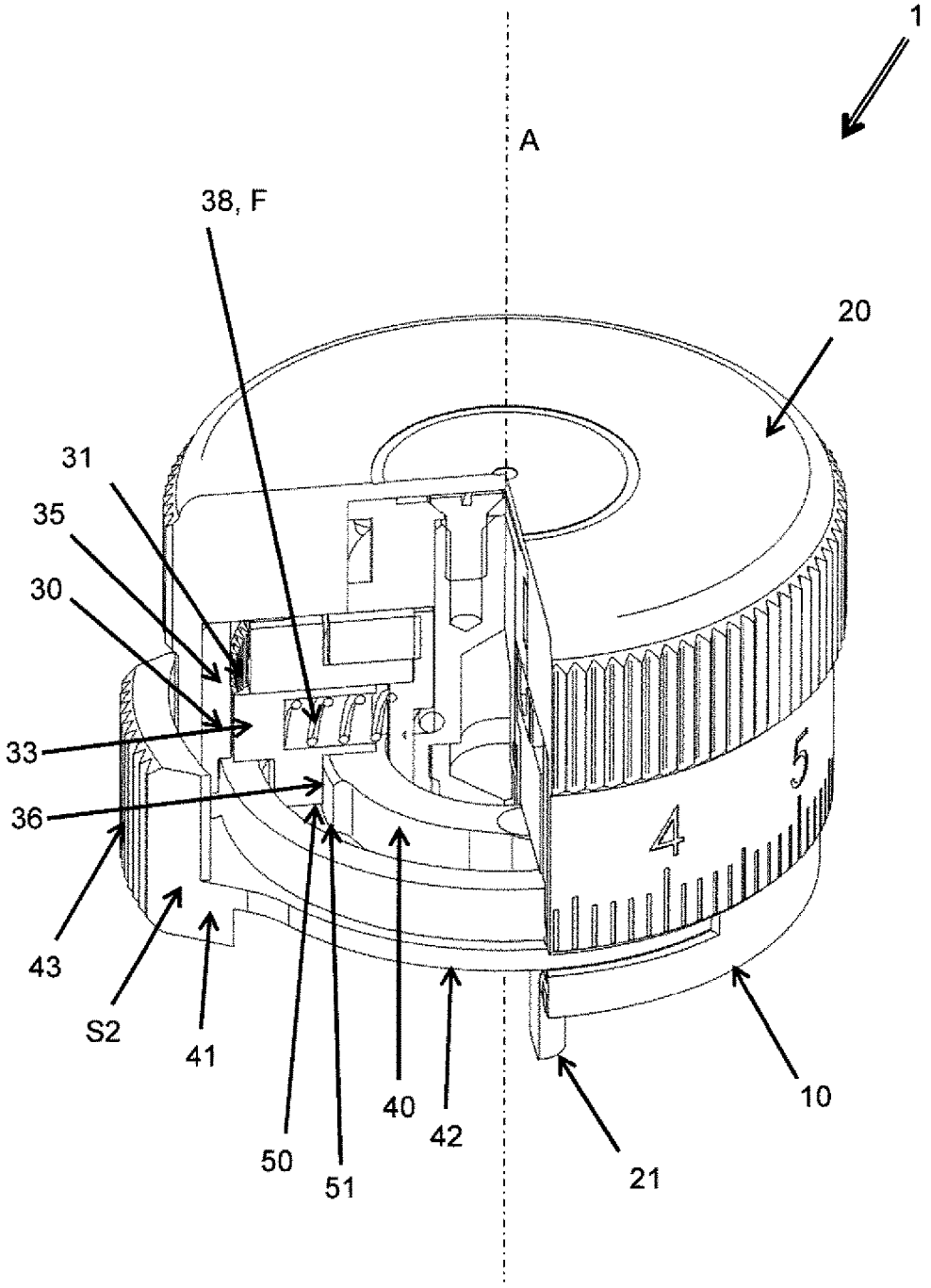

| | | | | |
|---|---|---|---|---|
| 2011/0100152 | A1 | 5/2011 | Huynh | |
| 2011/0261449 | A1* | 10/2011 | Schmitt | F41G 1/38<br>359/428 |
| 2013/0167425 | A1* | 7/2013 | Crispin | F41G 1/16<br>42/119 |
| 2014/0196351 | A1 | 7/2014 | Campean | |
| 2014/0352487 | A1* | 12/2014 | Crispin | F41G 1/38<br>74/553 |
| 2016/0169672 | A1* | 6/2016 | Oettl | F41G 1/38<br>356/247 |

FOREIGN PATENT DOCUMENTS

| | | |
|---|---|---|
| DE | 32 08 814 | 9/1983 |
| DE | 37 37 856 | 5/1989 |
| DE | 297 207 37 | 2/1998 |
| EP | 2 472 214 | 7/2012 |
| WO | 2010/008810 | 1/2010 |

* cited by examiner

ADJUSTING APPARATUS FOR SETTING A RIFLE SCOPE, AND RIFLE SCOPE EQUIPPED WITH THE ADJUSTING APPARATUS

The invention relates to an adjusting apparatus for setting a rifle scope according to the precharacterizing clause of Claim 1, and to a rifle scope which has an adjusting apparatus of this type according to Claim 17.

Rifle scopes have been developed in the last decades, above all for hunting purposes but also for military use. They typically consist of a rifle scope housing of a generally cylindrical shape which has in each case one tube with eyepiece and objective lens optics, respectively, at the ends, and in between these has a reversing arrangement for image erection. A crosshair, that is to say a target mark, is also situated in the said middle, narrower tube region. An actuating mechanism which projects radially at the middle tube region serves in general to adjust the said crosshair, for example a setting screw according to DE 32 08 814 A1 or DE 37 37 856 A1.

A setting option such that the point of aim and the impact point position coincide is important. If the distances from the target fluctuate greatly, parallax-induced deviations of the image plane of the target from the crosshair plane can be disruptive to an extraordinary extent. This can be compensated for by way of a parallax compensation. The said parallax compensation conventionally takes place by way of axial displacement of the objective lens. Moreover, manufacturing tolerances, shooting distance and side wind can lead to target mark deviations which have to be corrected by means of an adjusting apparatus. The said adjusting apparatuses, in particular also turret knobs, are usually arranged on the side of the rifle scope housing.

In order to adjust the crosshair, at least two adjusting apparatuses are arranged, in particular, on the outside of the rifle scope housing at circumferential intervals of 90 degrees, which adjusting apparatuses in each case have an adjusting device in the form of a click ring or an adjusting cap. Here, a first and second turret knob serve for the vertical and lateral adjustment, respectively.

For example, DE 297 207 37 U1 describes a rifle scope having a tubular housing which has tubular sockets for an eyepiece arrangement and an objective lens arrangement. Here, there are an optical reversing arrangement and a crosshair which is assigned to the latter in a middle tube, which crosshair is mounted fixedly in a socket on the double tube. A pinion which is provided with a thread is guided in a tubular body slot and presses onto the reversing arrangement from the front counter to a spring force. The said pinion can be moved to and fro in its longitudinal direction by way of rotation of the adjusting device.

An adjusting element of this type which can be rotated overall by approximately 360 degrees conventionally has a fine detent means with a pitch such that it in each case moves one step further during rotation (click adjustment), which changes the impact point position at 100 m, for example, by 10 mm. A scale is applied on the outer circumference of the adjusting apparatus, on which scale the correction which has been performed can be read off. Depending on the pitch, for example, each click is marked by a white line, whereas every tenth click is labelled with a number.

It is a problem in the case of the known embodiments in the prior art, however, that the crosshair device is adjusted unintentionally during a relocation of the shooter. An adjustment can occur, for example, by virtue of the fact that items of clothing rub on one of the adjusting elements.

It is therefore an object of the invention to develop an adjusting apparatus and a rifle scope which is equipped with the latter, which adjusting apparatus is as compact as possible in design and nevertheless can be actuated satisfactorily but at the same time is protected against unintentional adjustment. The turret knob is expediently to be of simple construction and inexpensive to produce, and robust and durable in use, and is to eliminate the further disadvantages of the prior art.

Main features of the invention are specified in the characterizing part of Claim 1 and in Claim 17. Refinements are the subject matter of Claims 2 to 16 and 18.

The invention relates to an adjusting apparatus for setting a rifle scope, having a manually actuable adjusting element which is mounted such that it can be rotated about a rotational axis relative to a base. A latching device is arranged between the base and the adjusting element, which latching device has latching depressions in a manner which is distributed over the circumference about the rotational axis, a first latching element of the latching device lying opposite one of the latching depressions in a manner which is dependent on the rotary position of the adjusting element relative to the base. According to the invention, the adjusting apparatus has a locking device which has a manually actuable locking element which can be moved manually from a released position into a locked position, the locking element being coupled to the first latching element via an actuating drive, the first latching element being fixed mechanically in the latching depression which lies opposite in each case in the locked position by means of the actuating drive, and a rotation of the adjusting element relative to the base being locked.

Therefore, a multiplicity of fixing positions for the adjusting element are provided in a manner which is dependent on the number of latching depressions, with the result that the said adjusting element is not adjusted unintentionally. Here, the utilization of the latching depressions which are distributed over the circumference allows them to be used in a dual function, namely for adjusting the adjusting element with click steps which can be discerned in a tactile manner, and fixing the adjusting element with the first latching element which likewise engages into one of the latching depressions. As a result, the adjusting apparatus can be designed to be compact and at the same time of simple construction. In the released position, the first latching element should not be fixed mechanically by the actuating drive in the latching depression which lies opposite in each case, with the result that a rotation of the adjusting element relative to the base is then released.

According to one special refinement, the latching depressions are configured in a click ring of the latching device. In this way, the latching depressions can be produced simply and inexpensively. Moreover, a material which is suitable for the function and differs from the other components can be selected for the click ring.

In one variant of the adjusting apparatus, the click ring is arranged so as to co-rotate on the rotatable adjusting element. In this way, the number of co-rotating components is kept low, and the assembly is particularly simple.

As an alternative, the click ring can also be configured in one piece with the adjusting element. As a result, the number of components is low.

In one optional embodiment, the latching depressions are of open configuration in the direction of the rotational axis. This permits a flat design of the adjusting element, since the latching element can be mounted between the rotational axis and the click ring. The adjusting element is preferably a hollow adjusting button. A button of this type is suitable for receiving the latching device and the locking device in the cavity and protecting them as a result. It is thus possible, for example, that the click ring is seated on the inner side of the hollow adjusting button.

According to a further design variant, the locking element is mounted such that it can be rotated relative to the base about the rotational axis between the released position and the locked position independently of the adjusting element. In this way, a common rotational axis can be used, as a result of which the design is compact. Moreover, the operation is possible in a comfortable manner.

A particularly compact design arises if the locking element has a disc body which is arranged between the base and the adjusting element and is mounted such that it can be rotated relative to the base about the rotational axis between the released position and the locked position independently of the adjusting element.

For comfortable actuation, an optional design may be suitable, in the case of which a gripping surface is arranged on the disc body, which gripping surface protrudes radially beyond the adjusting element relative to the rotational axis. On the said projecting length, the gripping surface can also form an angle and can extend along the rotational axis as far as next to the adjusting element, but preferably at most over an angle about the rotational axis of 90 degrees, further preferably of at most 60 degrees and particularly preferably of at most 45 degrees. In this way, it can be actuated satisfactorily.

An intuitively simple operation arises if a rotary angle about the rotational axis of substantially 90 degrees lies between the released position and the locked position.

It is optionally possible that the first latching element is loaded with a spring force in the direction of the latching depression which lies opposite in each case. In this case, the first latching element also serves in the released position for clicking which can be discerned in a tactile manner during an adjustment of the adjusting element. The functionality of the adjusting apparatus is increased with few components in this way. This embodiment should therefore preferably be selected if the first latching element is the only latching element of the latching device.

According to a further design option, at least one second latching element of the latching device lies opposite one of the latching depressions in a manner which is dependent on the rotary position of the adjusting element relative to the base, the at least one second latching element being loaded with a spring force in the direction of the latching depression which lies opposite in each case. In this way, the second latching element serves for clicking which can be discerned in a tactile manner during an adjustment of the adjusting element. It is then not absolutely necessary to also load the first latching element with a spring force in the direction of the latching depression which lies opposite in each case. Here, the first and second latching element share the latching depressions which are to be provided only once as a result.

The second latching element may optionally not be coupled to the locking element via the actuating drive or, in a second option, the locking element can be coupled to the at least one second latching element by the actuating drive, the at least one second latching element being fixed mechanically in the latching depression which lies opposite in each case in the locked position by means of the actuating drive, and a rotation of the adjusting element relative to the base being locked. In the first option, the second latching element is therefore used only for tactile clicking during the adjustment of the adjusting element and not for fixing purposes. In the second option, in contrast, the second latching element has a dual function, namely firstly with regard to the tactile clicking during the adjustment of the adjusting element and secondly with regard to locking thereof.

According to one special design variant, at least one third latching element of the latching device lies opposite one of the latching depressions in a manner which is dependent on the rotary position of the adjusting element relative to the base, the locking element being coupled to the at least one third latching element by the actuating drive, the at least one third latching element being fixed mechanically in the latching depression which lies opposite in each case in the locked position by means of the actuating drive, and a rotation of the adjusting element relative to the base being locked. By virtue of the fact that at least the first and the third latching elements are used to lock the rotation, the torque which can be absorbed is high and forcible further rotation of the adjusting element in the locked position is avoided.

In one special refinement, the first latching element and/or the at least one third latching element are mounted so as to slide freely. In other words, the said latching elements are not loaded with a spring force. Therefore, they do not serve for tactile clicking during the rotation of the adjusting element, but rather only for locking thereof.

The design of the latching elements and the latching depressions should generally be selected in such a way that the latching elements are pushed out of the latching depressions during a rotation of the adjusting element about the rotational axis.

A satisfactory compromise between a compact configuration and a locking action which can absorb high torques is provided by one embodiment, in which the adjusting apparatus is provided with at most two third latching elements and preferably exactly one third latching element. In this way, two or three latching elements are provided which are locked in the locked position, namely the first latching element and one or two third latching elements. They are optionally joined by a second latching element which is either merely spring-mounted or is likewise locked.

A simple and compact construction arises if the latching elements, comprising the first latching element and, if provided, the at least one second latching element and, if provided, the at least one third latching element, are mounted such that they can be displaced linearly in each case.

Here, the latching elements can be of slide-like configuration. In other words, the latching elements are then latching slides.

The latching depressions particularly preferably all lie on a (single) circulating path about the rotational axis.

In a special design which leads to a flat construction of the adjusting apparatus, it is provided that the latching elements, comprising the first latching element and, if provided, the at least one second latching element and, if provided, the at least one third latching element, are mounted in each case such that they can be displaced linearly towards and away from the rotational axis.

A simple construction and a manageable installation arise in one optional design, according to which the latching elements, comprising the first latching element and, if provided, the at least one second latching element and, if provided, the at least one third latching element, are mounted in each case in a rotationally fixed manner relative to the rotational axis, in particular on the base.

In one optional embodiment, the latching elements, comprising the first latching element and, if provided, the at least one second latching element and, if provided, the at least one third latching element, are arranged in a uniformly distributed manner about the rotational axis over the circumference. In this way, a uniform distribution of the forces which are introduced by way of the latching elements is achieved, and it is also achieved that high torques can be absorbed in the locked position. This results, for example, in a three-point or four-point locking action.

A more precise refinement is particularly simple and compact, in which the actuating drive has a control cam which kinematically couples the locking element to the first latching element and, if provided, to the at least one third latching element. Additionally, a second latching element can optionally be coupled kinematically to the control cam. A cam mechanism can be configured in this way.

There is the option here that the control cam is arranged so as to co-rotate on the locking element, and corresponds in each case with a sliding face of the first latching element and, if provided, of the at least one third latching element. Additionally, a second latching element can optionally have a sliding face, via which it is coupled kinematically to the control cam. The sliding faces can be configured in each case in one piece on the latching elements.

According to one special detailed solution, exclusively a pressure force in the direction of the latching depression which lies opposite in each case can be exerted by way of the control cam on the first latching element and, if provided, the at least one third latching element. In this way, the control cam is decoupled in the tensile direction from the first latching element and/or the at least one third latching element. This can also optionally be configured in this way between the control cam and a second latching element.

An adjusting apparatus of this type preferably has an adjusting pin, it being possible for the position of the adjusting pin to be set by way of the adjusting element, which adjusting pin is mounted such that it can be moved along the rotational axis. For example, a crosshair can be adjusted by way of an adjusting pin, by the adjusting pin exerting pressure on a reversing system which is mounted pivotably in the rifle scope housing and pivoting the said reversing system.

Moreover, the invention relates to a rifle scope having an adjusting apparatus as described in the above text and in the following text. In this way, a rifle scope with a comfortable and compact adjusting device is provided. In particular, the adjusting apparatus should be arranged with the base on a rifle scope housing of the rifle scope. In one option, the base is fixed on the rifle scope housing. In this way, the adjusting apparatus can be mounted or replaced simply and independently. In another option, the base is formed by a rifle scope housing of the rifle scope. In this way, fewer components and coupling points are necessary.

In one special embodiment, in order to adjust a crosshair, the adjusting apparatus is coupled to the crosshair. In this way, the adjusting element and therefore the crosshair can be fixed and/or locked with the aid of the locking device. Optionally, one of the latching elements can be used to provide click steps which can be discerned in a tactile manner, with the result that a shooter does not have to observe a scale during the adjustment, but rather can focus on the target. The desired setting is then achieved by way of counting the click steps.

Figure 2:
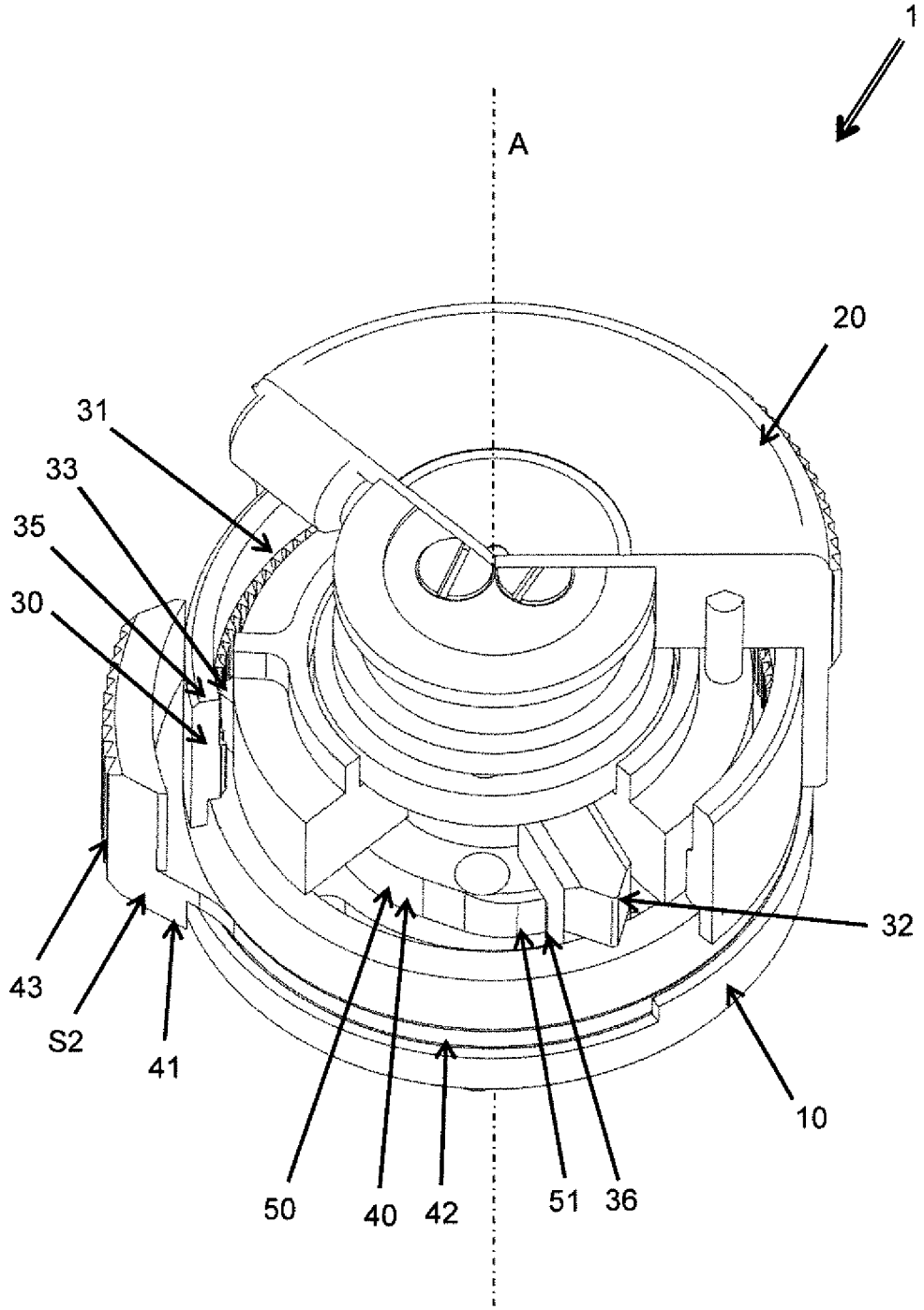
Figure 3:
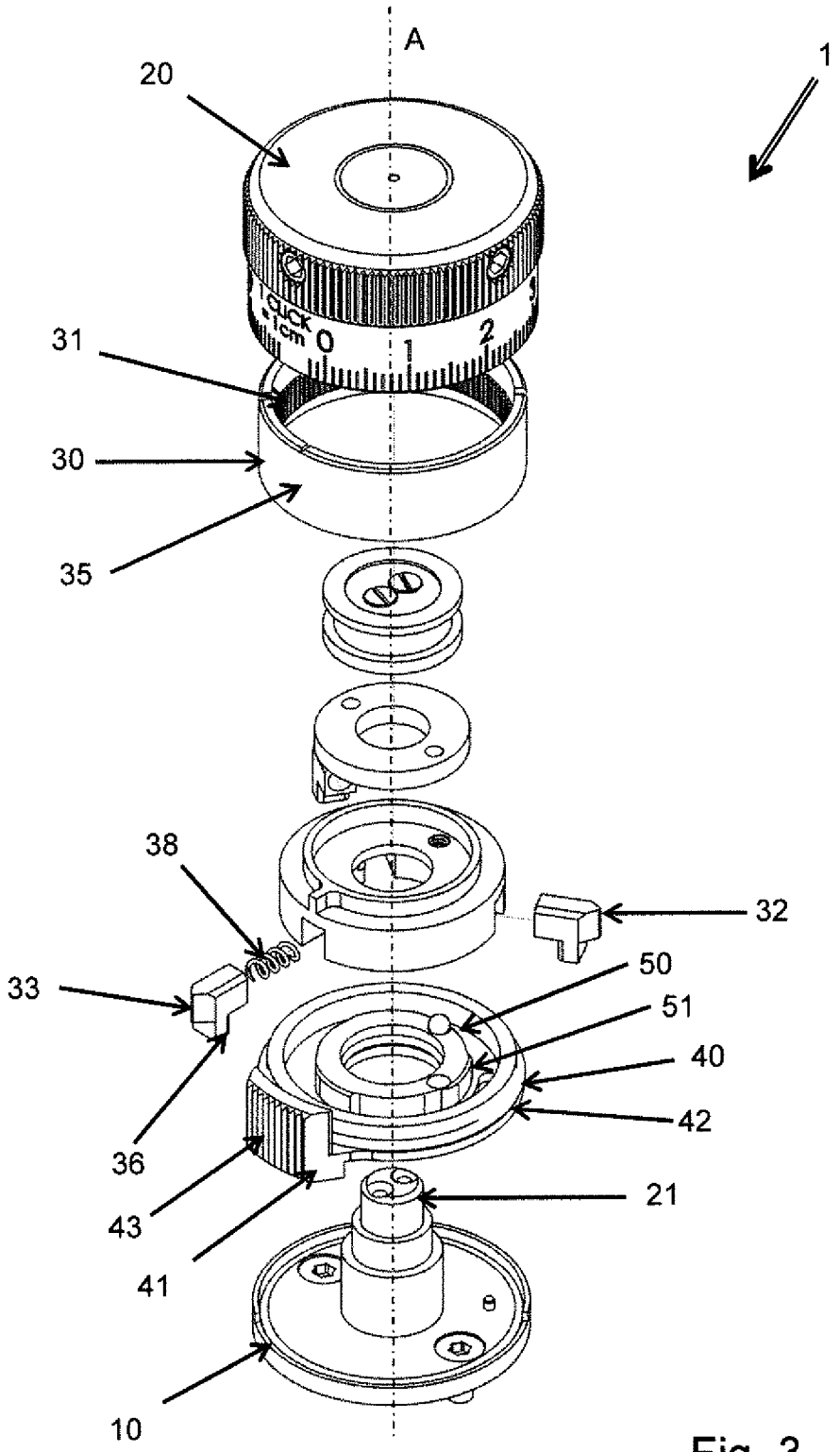
Figure 4:
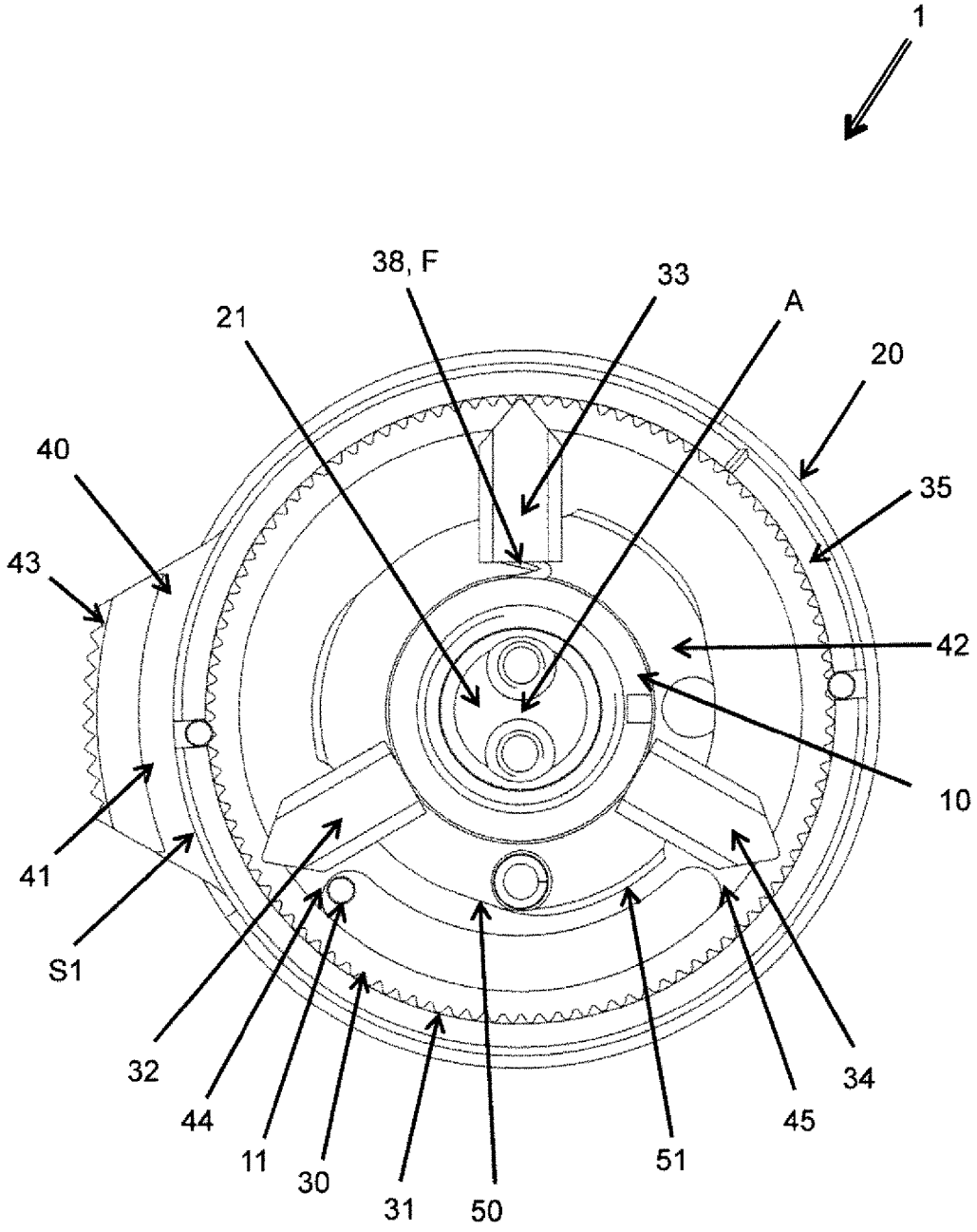
Figure 5:
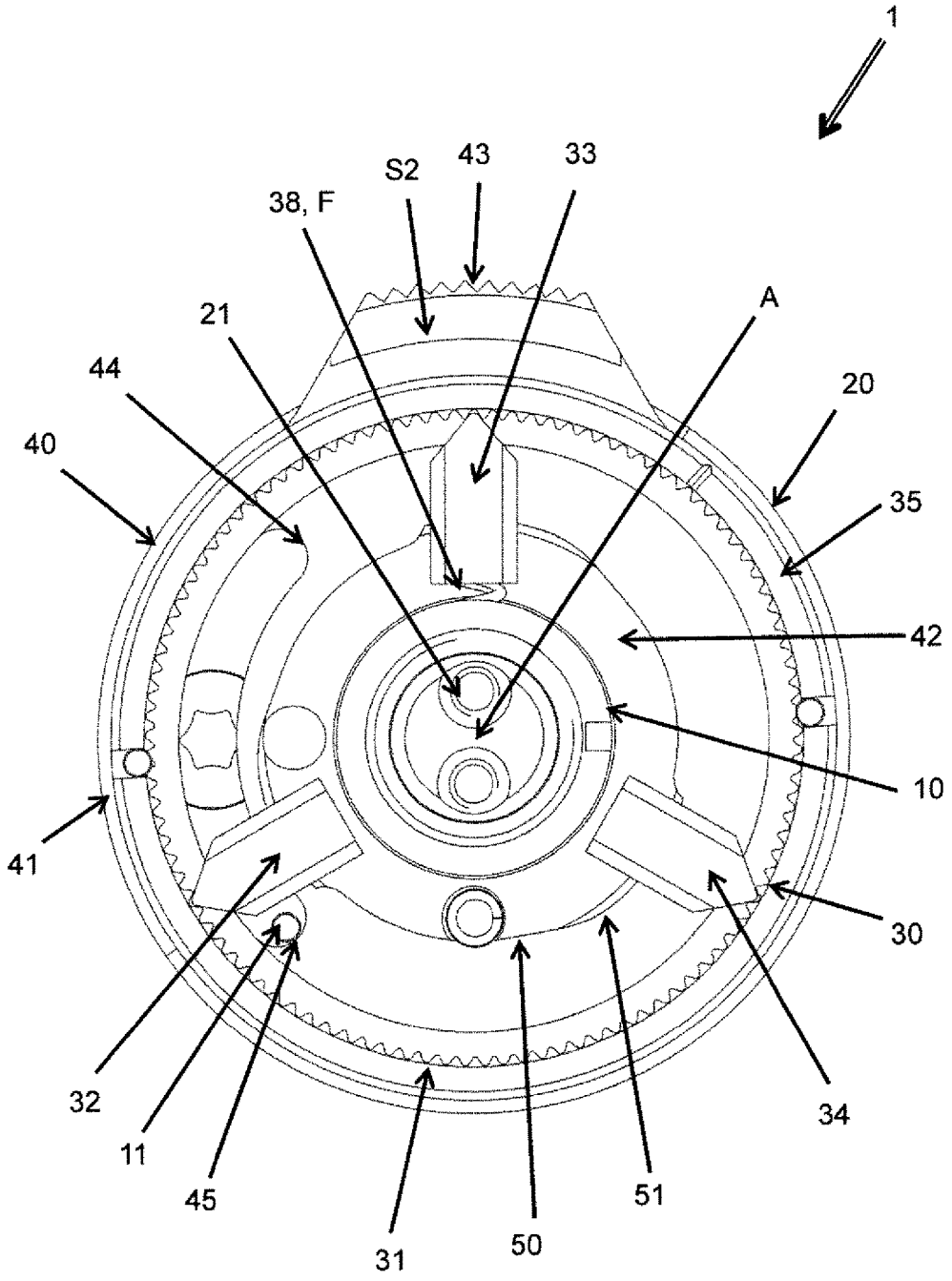
Figure 6:
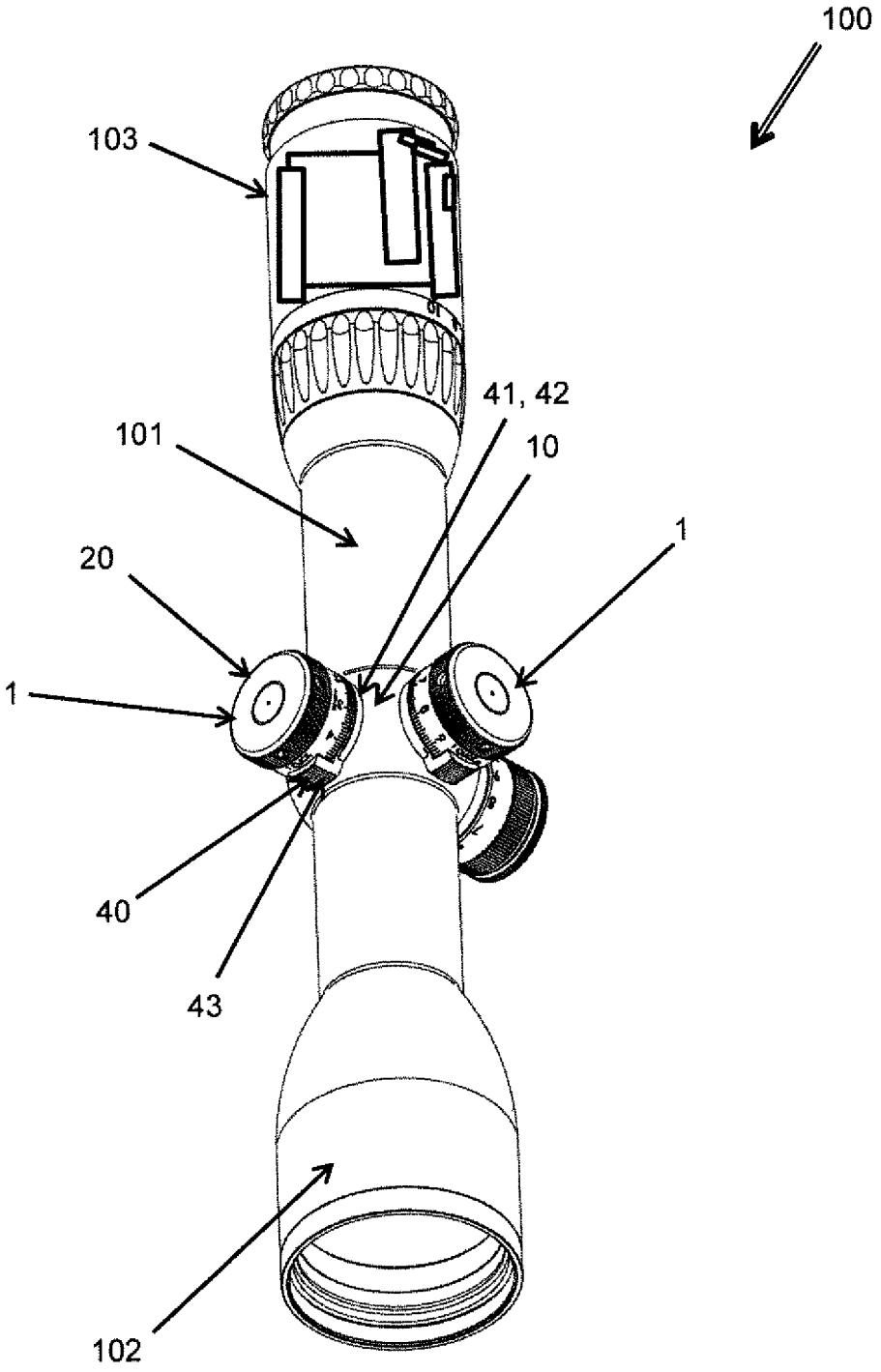

Further features, details and advantages of the invention arise from the wording of the claims and from the following description of exemplary embodiments using the drawings, in which:

FIG. 1 shows a perspective view with a 45° partial section of an adjusting apparatus, FIG. 2 shows a perspective view with a 225° partial section of an adjusting apparatus, FIG. 3 shows a perspective view of an exploded illustration of an adjusting apparatus, FIG. 4 shows a vertical view of an open adjusting apparatus in a released position, FIG. 5 shows a vertical view of an open adjusting apparatus in a locked position, and FIG. 6 shows a perspective view of a rifle scope having a plurality of adjusting apparatuses.

FIG. 1 shows a perspective view with a 45° partial section of an adjusting apparatus 1. FIG. 2 shows the same adjusting device 1 in a perspective view with a 225° partial section. FIG. 3 in turn shows the same adjusting apparatus 1, but in a perspective view of an exploded illustration. In particular, a released position S1 and a locked position D2 of a locking device 40 from a vertical view of an open adjusting apparatus 1 according to FIGS. 1, 2 and 3 are apparent from the views of FIGS. 4 and 5.

In FIGS. 1, 2, 3, 4 and 5, an adjusting apparatus 1 for setting a rifle scope can be seen in each case. The said adjusting apparatus 1 has a manually actuable adjusting element 20 which is mounted such that it can be rotated about a rotational axis A relative to a base 10. A latching device 30 is arranged between the base 10 and the adjusting element 20, which latching device 30 has latching depressions 31 in a manner which is distributed about the rotational axis A over the circumference. A first latching element 32 (not visible in FIG. 1), a second latching element 33 (not visible in FIG. 1) and a third latching element 34 (not visible in FIGS. 1, 2 and 3) of the latching device 30 lie opposite one of the latching depressions 31 in each case in a manner which is dependent on the rotary position of the adjusting element 20 relative to the base 10. The second latching element 33 is loaded with a spring force F (not illustrated in FIGS. 2 and 3), in the direction of the latching depression 31 which lies opposite in each case. Moreover, the adjusting apparatus 1 has a locking device 40 which has a manually actuable locking element 41 which can be moved manually from a released position S1 (see FIG. 4) into a locked position S2 (see FIG. 5). Here, the locking element 41 is coupled via an actuating drive 50 to the first latching element 32, the second latching element 33 and the third latching element 34. The first latching element 32, the second latching element 33 and the third latching element 34 are fixed mechanically in the latching depression 31 which lies opposite in each case in the locked position S2 (see FIG. 5) in each case by means of the actuating drive 50, and a rotation of the adjusting element 20 relative to the base 10 is locked.

This basic structure is one exemplary embodiment of the invention which is refined by way of the optional detailed solutions which are described in the following text. It can be seen in each case in FIGS. 1, 2, 3, 4 and 5 that the latching depressions 31 are configured in a click ring 35 of the latching device 30. Here, the latching depressions 31 are of open configuration in the direction of the rotational axis A.

The click ring 35 is arranged so as to co-rotate on the rotatable adjusting element 20. The adjusting element 20 is a hollow adjusting button. The click ring 35 is seated in the latter on the inner side. This position is achieved by way of the click ring 35 being plugged into the hollow adjusting button.

The locking element 41 is mounted such that it can be rotated about the rotational axis A relative to the base 10 between the released position S1 and the locked position S2 independently of the adjusting element 20. Here, the locking element 41 has a disc body 42 which is arranged between the base 10 and the adjusting element 20 and is mounted such that it can be rotated about the rotational axis A relative to the base 10 between the released position S1 and the locked position S2 independently of the adjusting element 20. In particular, a rotary angle about the rotational axis of 90 degrees lies between the released position S1 (see FIG. 4) and the locked position S2 (see FIG. 5). The rotary angle is delimited by way of stops 44, 45. In particular, the first stop 44 bears against a stop element 11 (see FIGS. 3, 4 and 5) in the released position S1 (see FIG. 4). The second stop 45 bears against the same stop element 11 (see FIGS. 3, 4 and 5) in the locked position S2 (see FIG. 5).

It can be seen, furthermore, that a gripping surface 43 is arranged on the disc body 42, which gripping surface 43 protrudes radially beyond the adjusting element 20 relative to the rotational axis A. On the said protruding projecting length, the gripping surface 43 forms an angle, with which it extends along the rotational axis A as far as next to the adjusting element 20. However, the height of the gripping surface 43 along the rotational axis A is less than 50% of the height of the adjusting element 20 (cf., in particular, FIG. 1). Moreover, the gripping surface 43 extends in the circumferential direction around the adjusting element by less than 90 degrees, less than 60 degrees and, in particular, less than 45 degrees (cf., in particular, FIGS. 4 and 5).

The first latching element 32, the second latching element 33 and the third latching element 34 are mounted in each case on the base 10 and therefore do not rotate about the rotational axis A. As can be seen, the first latching element 32, the second latching element 33 and the third latching element 34 are mounted in each case such that they can be displaced linearly, in particular perpendicularly with respect to the rotational axis A and towards and away from the rotational axis A. Here, the first latching element 32 and the third latching element 34 are mounted so as to slide freely and are not loaded with a spring force (cf., in particular, FIGS. 4 and 5). The latching elements 32, 33, 34 are therefore of slide-like configuration. In other words, the latching elements 32, 33, 34 are then latching slides.

During a rotation of the adjusting element 20 about the rotational axis A, the said latching elements 32, 34 are then pushed out of the locked position by the latching depressions 31, in particular on a one-time basis. In contrast, the second latching element 33 jumps into each passing latching depression 31 on account of the spring 38 and the spring force F.

The star-shaped orientation of the latching elements 32, 33, 34 about the rotational axis A can be seen, in particular, in FIGS. 4 and 5. In particular, the first latching element 32, the second latching element 33 and the third latching element 34 are arranged in a uniformly distributed manner about the rotational axis A over the circumference.

In order to adjust or in order to lock the latching elements 32, 33, 34, the actuating drive 50 has a control cam 51 which couples the locking element 41 kinematically to the first latching element 32 and the third latching element 34. In each case one elevation of the control cam 51 presses one of the latching elements 32, 33, 34 in the locked position S2 into a latching recess 31 (see FIG. 5).

The control cam 41 is configured on the locking element 41 in a co-rotating and single-piece manner, in particular on the disc body 42, and corresponds with in each case one sliding face 36 of the latching elements 32, 33, 34.

Exclusively a pressure force in the direction of the latching depression 31 which lies opposite in each case can be exerted on the latching elements 32, 33, 34 by way of the control cam 41. That is to say, the control cam 41 is decoupled from the latching elements 32, 33, 34 in the tensile direction.

The position of an adjusting pin 21 can be set by way of the adjusting element 20 as a result of rotation about the rotational axis A, which adjusting pin 21 is mounted such that it can be moved along the rotational axis A. To this end, the adjusting pin 21 is preferably screwed with a thread into the base 10.

FIG. 6 shows a perspective view of a rifle scope 100 having a plurality of adjusting apparatuses 1 of the type according to FIGS. 1, 2, 3, 4 and 5. In particular, two adjusting apparatuses 1 are attached to a middle part of a rifle scope housing 101 offset with respect to one another by a rotary angle of 90 degrees. To this end, the base 10 is in contact in each case with the rifle scope housing 101. As an alternative, however, the base 10 can also be configured directly by the rifle scope housing 101.

An objective lens 102 and an eyepiece 103 are seated on the end sides in the tube-like rifle scope housing 101. A pivotably mounted reversing system is arranged in the rifle scope housing 101 in the middle part between the objective lens 102 and the eyepiece 103. The position of a crosshair relative to a target position can be set by way of pivoting of the reversing system, in particular in order to set a shooting distance or to compensate for side winds. The said pivoting is performed by way of the two adjusting apparatuses 1. It can also be seen clearly in FIG. 6 that the gripping surface 43 on the disc body 42 of the locking element 41 does not project as far from the rifle scope housing 101 as the adjusting element 20.

The invention is not restricted to one of the above-described embodiments, but rather can be modified in a wide variety of ways.

As an alternative or in addition to the embodiment which is shown, the first latching element 32 might also be loaded with a spring force F in the direction of the latching depression 31 which lies opposite in each case.

There is in general the option that only a first latching element 32 is provided, or else a plurality of latching elements from the group comprising first, second and third latching element 32, 33, 34, but preferably at most five.

One modification can also consist in that the sprung second latching element 33 is not coupled via the actuating drive 50 to the locking element 41.

All of the features and advantages which are apparent from the claims, the description and the drawing, including structural details, spatial arrangements and method steps, can be essential to the invention both per se and also in a very wide variety of combinations.

LIST OF REFERENCE NUMERALS

1 Adjusting apparatus
10 Base
11 Stop element
20 Adjusting element
21 Adjusting pin
30 Latching device
31 Latching depressions
32 First latching element
33 Second latching element
34 Third latching element
35 Click ring
36 Sliding face (first latching element)
38 Spring
40 Locking device

41 Locking element
42 Disc body
43 Gripping surface
44 First stop (released position)
45 Second stop (locked position)
50 Actuating drive
51 Control cam
100 Rifle scope
101 Rifle scope housing
102 Objective lens
103 Eyepiece
A Rotational axis
F Spring force
S1 Released position
S2 Locked position

The invention claimed is:

1. An adjusting apparatus (1) for setting a rifle scope (100), having a manually actuable adjusting element (20)

which is mounted such that it can be rotated about a rotational axis (A) relative to a base (10), a latching device (30) being arranged between the base (10) and the adjusting element (20), which latching device (30) has latching depressions (31) in a manner which is distributed over the circumference about the rotational axis (A), a first latching element (32) of the latching device (30) lying opposite one of the latching depressions (31) in a manner which is dependent on the rotary position of the adjusting element (20) relative to the base (10), wherein the adjusting apparatus (1) has a locking device (40)

which has a manually actuable locking element (41)

which can be moved manually from a released position (S1) into a locked position (S2), the locking element (41) being coupled to the first latching element (32) via an actuating drive (50), the first latching element (32) being fixed mechanically in the latching depression (31) which lies opposite in each case in the locked position (S2) by means of the actuating drive (50), and a rotation of the adjusting element (20) relative to the base (10) being locked, and wherein the actuating drive (50) has a control cam (51) which kinematically couples the locking element (41) to the first latching element.

2. The adjusting apparatus (1) according to claim 1, characterized in that the latching depressions (31) are configured in a click ring (35) of the latching device (30).

3. The adjusting apparatus (1) according to claim 2, characterized in that the click ring (35) is arranged so as to co-rotate on the rotatable adjusting element (20).

4. The adjusting apparatus (1) according to claim 1, characterized in that the latching depressions (31) are of open configuration in the direction of the rotational axis (A).

5. The adjusting apparatus (1) according to claim 1, characterized in that the locking element (41) is mounted such that it can be rotated relative to the base (10) about the rotational axis (A) between the released position (S1) and the locked position (S2) independently of the adjusting element (20).

6. The adjusting apparatus (1) according to claim 1, characterized in that the locking element (41) has a disc body (42) which is arranged between the base (10) and the adjusting element (20) and is mounted such that it can be rotated relative to the base (10) about the rotational axis (A) between the released position (S1) and the locked position (S2) independently of the adjusting element (20).

7. The adjusting apparatus (1) according to claim 6, characterized in that a gripping surface (43) is arranged on the disc body (42), which gripping surface (43) protrudes radially beyond the adjusting element (20) relative to the rotational axis (A).

8. The adjusting apparatus (1) according to claim 1, characterized in that the first latching element (32) is loaded with a spring force (F) in the direction of the latching depression (31) which lies opposite in each case.

9. The adjusting apparatus (1) according to claim 1, characterized in that at least one second latching element (33) of the latching device (30) lies opposite one of the latching depressions (31) in a manner which is dependent on the rotary position of the adjusting element (20) relative to the base (10), the at least one second latching element (33) being loaded with a spring force (F) in the direction of the latching depression (31) which lies opposite in each case.

10. The adjusting apparatus (1) according to claim 9, characterized in that at least one third latching element (34) of the latching device (30) lies opposite one of the latching depressions (31) in a manner which is dependent on the rotary position of the adjusting element (20) relative to the base (10), the locking element (41) being coupled to the at least one third latching element (34) via the actuating drive (50), the at least one third latching element (34) being fixed mechanically in the latching depression (31) which lies opposite in each case in the locked position (S2) by means of the actuating drive (50), and a rotation of the adjusting element (20) relative to the base (10) being locked.

11. The adjusting apparatus (1) according to claim 10, characterized in that the third latching element (32) is mounted such that the third latching element can be displaced linearly in each case.

12. The adjusting apparatus (1) according to claim 10, characterized in that the third latching element (32) is mounted in each case in a rotationally fixed manner relative to the rotational axis (A).

13. The adjusting apparatus (1) according to claim 10, characterized in that the third latching element (32) is arranged in a uniformly distributed manner about the rotational axis (A) over the circumference.

14. The adjusting apparatus (1) according to claim 10, characterized in that the control cam (51) couples the locking element (41) to the third latching element.

15. The adjusting apparatus (1) according to claim 10, characterized in that the control cam (51) is arranged so as to co-rotate on the locking element (41), and corresponds in each case with a sliding face (36) of the first latching element (32) and the at least one third latching element (34).

16. The adjusting apparatus (1) according to claim 10, characterized in that exclusively a pressure force in the direction of the latching depression (31) which lies opposite in each case can be exerted by way of the control cam (41) on the first latching element (32) and, if provided, the at least one third latching element (34).

17. The adjusting apparatus (1) according to claim 9, characterized in that the second latching element (32) is mounted such that the second latching element can be displaced linearly in each case.

18. The adjusting apparatus (1) according to claim 9, characterized in that the second latching element (32) is mounted in each case in a rotationally fixed manner relative to the rotational axis (A).

19. The adjusting apparatus (1) according to claim 9, characterized in that the second latching element (32) is arranged in a uniformly distributed manner about the rotational axis (A) over the circumference.

20. The adjusting apparatus (1) according to claim 1, characterized in that the first latching element (32) is mounted such that the first latching element can be displaced linearly in each case.

21. The adjusting apparatus (1) according to claim 1, characterized in that the first latching element (32) is mounted in each case in a rotationally fixed manner relative to the rotational axis (A).

22. The adjusting apparatus (1) according to claim 1, characterized in that the first latching element (32) is arranged in a uniformly distributed manner about the rotational axis (A) over the circumference.

23. The adjusting apparatus (1) according to claim 1, characterized in that the control cam (51) is arranged so as to co-rotate on the locking element (41), and corresponds in each case with a sliding face (36) of the first latching element (32).

24. The adjusting apparatus (1) according to claim 23, characterized in that exclusively a pressure force in the direction of the latching depression (31) which lies opposite in each case can be exerted by way of the control cam (41) on the first latching element (32).

25. A rifle scope (100) having an adjusting apparatus (1) according to claim 1.

26. A rifle scope (100) according to claim 25, characterized in that, in order to adjust a crosshair, the adjusting apparatus (1) is coupled to the crosshair.

* * * * *